US012467714B2

(12) United States Patent
Chia

(10) Patent No.: US 12,467,714 B2
(45) Date of Patent: Nov. 11, 2025

(54) AIR PISTON ASSEMBLY AND TOY LAUNCHER INCLUDING THE SAME

(71) Applicant: EASEBON SERVICES LIMITED, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 18/118,996

(22) Filed: Mar. 8, 2023

(65) Prior Publication Data

US 2024/0302128 A1 Sep. 12, 2024

(51) Int. Cl.
*F41B 11/646* (2013.01)
*F41B 11/55* (2013.01)
*F41B 11/89* (2013.01)

(52) U.S. Cl.
CPC ..... *F41B 11/646* (2013.01); *F41B 11/55* (2013.01); *F41B 11/89* (2013.01)

(58) Field of Classification Search
CPC ..... F41B 11/55; F41B 11/64; F41B 11/642; F41B 11/646; F41B 11/647; F41B 11/89
USPC ..... 124/56
See application file for complete search history.

(56) References Cited

U.S. PATENT DOCUMENTS 3,111,121 A * 11/1963 Baggott ..... F41B 11/642 124/52
3,818,887 A * 6/1974 Akiyama ..... F41B 11/646 124/67
4,212,285 A * 7/1980 Cagan ..... F42B 6/10 124/67
4,732,136 A * 3/1988 Ferri ..... F41B 11/55 124/67
4,843,751 A * 7/1989 Ferri ..... F41B 11/55 124/67
4,881,517 A * 11/1989 Wackrow ..... F41B 11/50 124/63
4,986,251 A * 1/1991 Lilley ..... F41B 11/54 124/52
9,239,206 B1 * 1/2016 Nguyen ..... F41B 11/646
9,389,042 B1 * 7/2016 Clayton ..... F41B 11/642
9,562,739 B2 * 2/2017 Busse ..... F41B 11/643
11,243,044 B2 * 2/2022 Chia ..... F41A 9/66
12,173,981 B2 * 12/2024 Schoonmaker ..... F41B 11/70
(Continued)

FOREIGN PATENT DOCUMENTS

CN 113295045 A * 8/2021 ..... F41B 11/64
JP 2866337 B2 * 3/1999 ..... F41B 11/12
WO 2021225524 A1 11/2021

*Primary Examiner* — Troy Chambers
*Assistant Examiner* — Benjamin S Gomberg
(74) *Attorney, Agent, or Firm* — Amster, Rothstein & Ebenstein LLP

(57) ABSTRACT

An air piston assembly including a piston cylinder having a main cylinder portion and a piston cylinder extension portion that extends from the main cylinder portion and that is configured to travel between extension arms of a standard projectile magazine, a piston head configured to travel in and out of the piston cylinder, the piston head having an extension that is aligned with the piston cylinder extension portion, a piston arm extending from the piston head, and a piston spring disposed around the piston arm. In exemplary embodiment, a toy launcher incorporates the air piston assembly.

15 Claims, 11 Drawing Sheets

(56) References Cited

U.S. PATENT DOCUMENTS

| | | | | |
|---|---|---|---|---|
| 2010/0147277 | A1* | 6/2010 | Zimmerman | F41B 11/55<br>124/56 |
| 2019/0107358 | A1* | 4/2019 | Spielberger | F41B 7/006 |
| 2019/0113303 | A1* | 4/2019 | Johnson | F41B 11/55 |
| 2024/0310141 | A1* | 9/2024 | Davis | F41B 11/643 |

* cited by examiner

AIR PISTON ASSEMBLY AND TOY LAUNCHER INCLUDING THE SAME

FIELD

The present disclosure is generally related to a toy projectile launcher, such as a toy pistol, gun, and the like, for launching toy projectiles, such as foam bullets, darts, balls, and the like, with an air piston assembly.

BACKGROUND

Traditional toy projectile launchers have utilized various forms of rifles, pistols, blasters, machine guns, and the like, for launching toy projectiles, such as foam balls, darts, to name a few. Such toy launchers have varied in size, power, storage capacity, to name a few. More specifically, toy launchers of foam projectiles—bullets (or "darts"), balls, and the like—have become ubiquitous. There have been various types of rifles, machine guns, and the like, that have been marketed for launching such foam projectiles.

A conventional air driven piston blaster has a piston, that is connected to an air exit tube, which is, in turn, used as the pusher rod to move a dart from the top of a magazine into the front firing barrel. When activated, the piston drives the air out from the piston cylinder, through the air exit tube, to exert force at the rear of the dart, to propel it out of the blaster.

Such air piston actuated launchers have some disadvantages. First, a long pusher rod is required. The top inwardly biased open arms to a standard magazine are fixed in position, and rigid because they need to prevent the top dart from exiting the magazine. As such, the pusher rod/arm must be at least the length of the dart or the width of the magazine in which the darts sit. The length of any blaster needs to factor in the dimensions of this mechanical construction. Moreover, there is air pressure loss during the travel inside the pusher rod. One could overcome this by using a stronger spring, which, of course, will mean a heavier force to load. However, for adult blasters, which already use strong springs, any increment to the loading force is a negative.

A second disadvantage is that the launcher needs to be primed or loaded before the magazine can be inserted/extracted. When the launcher is at rest, the pusher rod has moved forward, which prevents the magazine from being fully inserted and locked into place. Loading the blaster will move the pusher rod back (as the piston is moved back) and will clear the way for the magazine to be properly inserted. One way of overcoming this is to use a "skinny pusher" which is where the normally circular/round pusher rod is modified to have a diminished profile to allow it to move through the two rigid top arms of a magazine. As such, one could insert/extract a magazine without first having to prime/load the blaster. However, there will be loss of air pressure when the air has to pass through this constricted area in the pusher rod. Again, one could overcome this with the use of a stronger spring, but with the negative consequential heavier loading force.

There have been recent developments that address these issues. For example, U.S. Pat. No. 11,243,044 and PCT Publication No. WO2021/225524 disclose the use of "hinged fingers" to allow for the air piston cylinder to pass through. Both designs allow for the shortest possible air exit tube, thereby maximizing the outgoing air pressure as well as attaining a short blaster. However, both designs require dedicated magazines, and are not cross compatible with the host of available magazines in the market.

Accordingly, there is a need for an improved air piston assembly that allows for use of standard magazines without negatively impacting air pressure for ejecting projectiles while allowing for a smaller overall launcher dimensional profile.

SUMMARY

To address the above, exemplary embodiments of the present invention provide a launcher that has a piston mechanism that obviates the need for a pusher rod, which in turn allows for the design of a smaller launcher. The absence of the traditional air pusher rod means that the air from the piston cylinder would almost directly impact on the rear of a dart, thereby realizing the maximum use of the air pressure. This also has the benefit of keeping the loading strength required to its lowest level to prime/load a launcher in relation to the blaster's physical size.

Further, since a traditional pusher rod is absent, the magazine can be inserted/extracted without first having to load the launcher or to suffer an air pressure loss from a "skinny pusher".

Still further, the space normally used for the traditional push rod can now be used to house a longer spring, which would lower the priming/loading force required, resulting in a more user-friendly launcher.

An air piston assembly according to an exemplary embodiment of the present invention comprising: a piston cylinder comprising a main cylinder portion and a piston cylinder extension portion that extends from the main cylinder portion and that is configured to travel between extension arms of a standard projectile magazine; a piston head configured to travel in and out of the piston cylinder, the piston head comprising an extension that is aligned with the piston cylinder extension portion; a piston arm extending from the piston head; and a piston spring disposed around the piston arm.

In exemplary embodiments, the piston cylinder extension portion comprises an air exit hole.

In exemplary embodiments, the air piston assembly further comprises an O-ring disposed at the front of the piston head.

In exemplary embodiments, the air piston assembly further comprises an O-ring disposed at the front of the piston cylinder extension.

In exemplary embodiments, the air piston assembly further comprises an adapter for connecting the piston cylinder extension to a launch barrel of a toy projectile launcher.

In exemplary embodiments, the piston head is configured to be propelled forward by the piston spring upon release of the piston head from a locked position so as to drive air from the piston cylinder and out of the air exit hole to fire a toy projectile from a launcher.

A toy launcher in accordance with exemplary embodiments of the present invention comprises the air piston assembly as described above.

A toy launcher according to an exemplary embodiment of the present invention comprises: a housing; a rear handle extending from the housing; a front handle slidably disposed on the housing and attached to a lever arm within the housing; an opening configured for insertion of a spring-loaded magazine holding projectiles; a trigger assembly comprising a trigger and a trigger arm attached to the trigger; and an air piston assembly comprising: a piston cylinder comprising a main cylinder portion and a piston cylinder extension portion that extends from the main cylinder portion and that is configured to travel between extension arms of a standard projectile magazine, the piston cylinder extension comprising an air exit hole and the piston cylinder being attached to the lever arm; a piston head configured to travel in and out of the piston cylinder, the piston head comprising an extension that is aligned with the piston cylinder extension portion; a piston arm extending from the piston head; and a piston spring disposed around the piston arm, wherein upon sliding of the front handle backwards, the air piston assembly is pushed backwards by the lever arm, the piston head is locked into a cocked position, and a top-most projectile within the magazine is pushed into a position within the launcher formerly occupied by the piston cylinder extension, wherein upon sliding of the front handle forwards the piston cylinder is pulled forward by the lever arm to thereby create a volume of air within the piston cylinder and to push the projectile into the launch barrel, and wherein upon activation of the trigger the piston head is released from the cocked position and is driven forward into the piston cylinder by the piston spring to thereby eject the volume of air from the piston cylinder and out of the air exit hole of the piston cylinder extension to fire the projectile from the launch barrel.

In exemplary embodiments, the toy launcher further comprises a latching assembly that locks the piston head in the cocked position.

In exemplary embodiments, upon activation of the trigger the trigger arm engages with the latch assembly to release the latching assembly from the piston head.

In exemplary embodiments, the toy launcher further comprises an O-ring disposed at the front of the piston head.

In exemplary embodiments, the toy launcher further comprises an O-ring disposed at the front of the piston cylinder extension.

In exemplary embodiments, the toy launcher further comprises an adapter for connecting the piston cylinder extension to the launch barrel.

BRIEF DESCRIPTION OF THE DRAWINGS

Exemplary embodiments of the present invention will be described with references to the accompanying figures, wherein.

DETAILED DESCRIPTION

The present invention is generally related to an air piston assembly and associated launcher that allows for use of commercially available standard magazines for loading of projectiles into the launcher. That is, the air piston assembly is configured to allow for insertion of conventional magazines into a launcher without requiring any modifications to the magazines to allow for functioning with the air piston assembly and other internal mechanisms of the launcher. As explained in detail herein, the air piston assembly according to exemplary embodiments of the present invention does not require a front protrusion or "air pusher rod" to move a projectile into a launch position, but instead achieves this function through the use of a piston cylinder extension that is configured to travel between the rigid upper arms of a standard magazine to allow a top-most projectile within the magazine to be spring-loaded into the launcher and be pushed into a firing position within a launch barrel of the launcher. The piston cylinder extension includes an air exit hole that ejects air upon triggering of the launcher to fire the projectile.

For clarity and simplicity in illustrating the key elements and mechanisms of the air piston assembly and launcher in accordance with exemplary embodiments of the present invention, portions that are not necessary to understand the scope and the spirit of the present invention are not shown. One of ordinary skill in the art would readily understand the supporting elements needed to house and support the various illustrated elements with various design choices that would not depart from the spirit and scope of the present invention.

Although the present invention is described in the context of a manual spring-loaded launcher, it should be appreciated that the air piston assembly in accordance with exemplary embodiments of the present invention may also be used in a battery-operated piston driven launcher.

Figure 1:
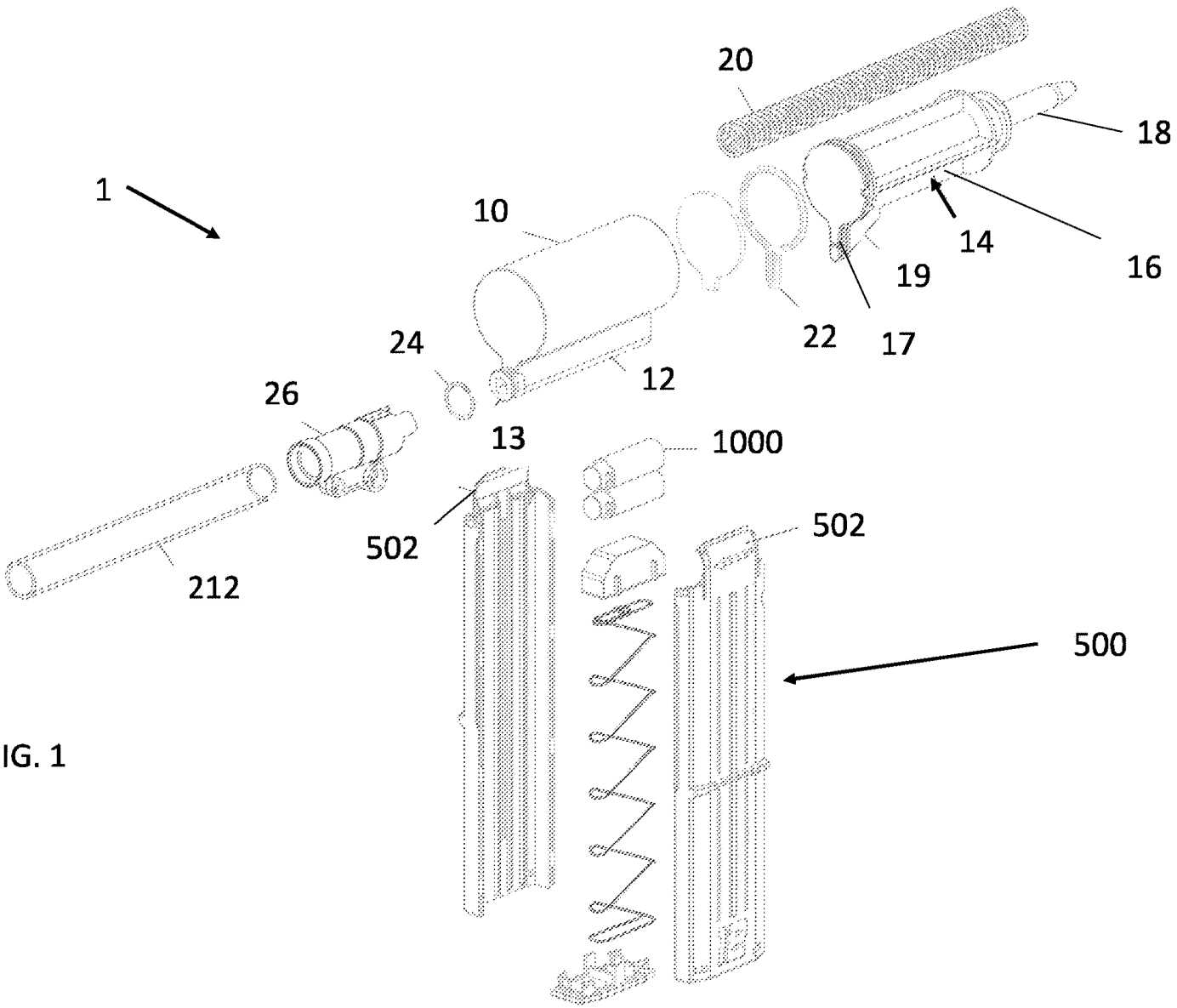
FIG. 1 shows an exploded perspective view of an air piston assembly according to an exemplary embodiment of the present invention.
Figure 2:
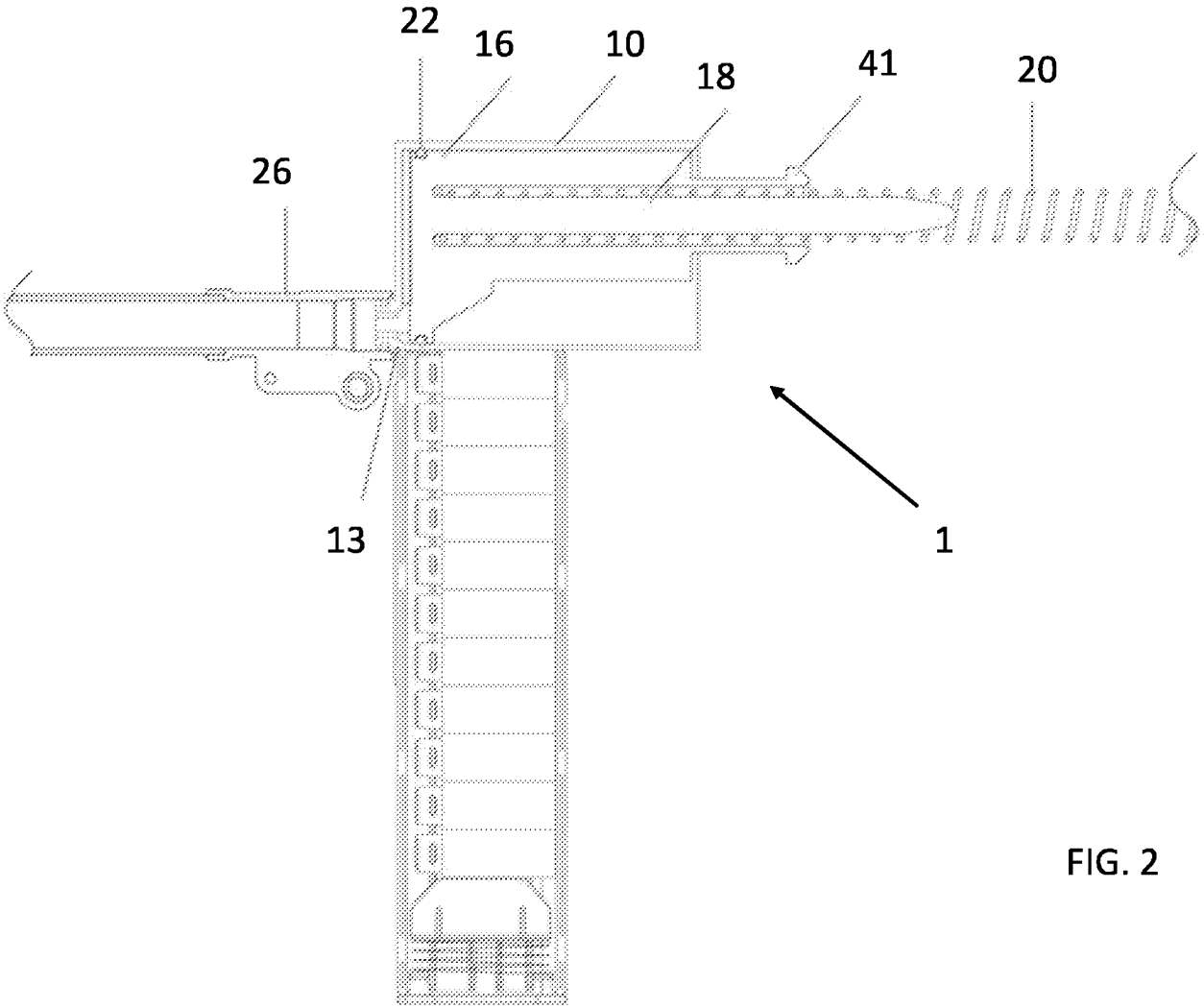
FIG. 2 shows a side sectional view of an air piston assembly according to an exemplary embodiment of the present invention.

FIG. 1 shows an exploded perspective view of an air piston assembly, generally designated by reference number 1, according to an exemplary embodiment of the present invention in use with a magazine 500 of a toy launcher and FIG. 2 shows a side sectional view of the air piston assembly 1 also in use with the magazine 500. The air piston assembly 1 is made up of a piston cylinder 10 with a piston cylinder extension 12. An air exit hole 13 is formed at the front of the piston cylinder extension 12. As described in more detail below, the piston cylinder extension 12 is configured to move between two rigid, inwardly biased upper arms 502 of the magazine 500. Although the piston cylinder extension 12 is shown protruding from the bottom of the piston cylinder 10, it should be appreciated that in other exemplary embodiments the piston cylinder extension 12 may protrude from any other side of the piston cylinder 10, and for example may protrude from the top of the piston cylinder 10 in the case of, for example, a top loading launcher.

The piston cylinder assembly 1 further includes a piston 14 made up of a piston head 16 and a piston arm 18 extending from the piston head 16. A flange 41 is disposed at the rear of the piston head 16, which as described in more detail below allows for the piston 14 to be locked in cocked position. The front portion of the piston head 16 has a protrusion 17 that is in line with the piston cylinder extension 12. In exemplary embodiments, the piston head 16 may include a support wall 19 that reinforces the protrusion 17 as it travels forward to compensate for structural stresses. A piston spring 20 extends around the piston arm 18. A first O-ring 22 is disposed at the front of the piston head 16. A second O-ring 24 is disposed at the front of the bottom extension 12 and forms an air seal when the air exit hole 13 of the bottom extension 12 has been pushed into the rear of a launch barrel 212 of a launcher (as explained in more detail below). An adapter 26 may be disposed between the bottom extension 12 and the launch barrel to hold the launch barrel in place and also has a flared entrance at the rear to aid the insertion of a projectile, such as a dart 1000.

Figures 3A, 3B, 3C:
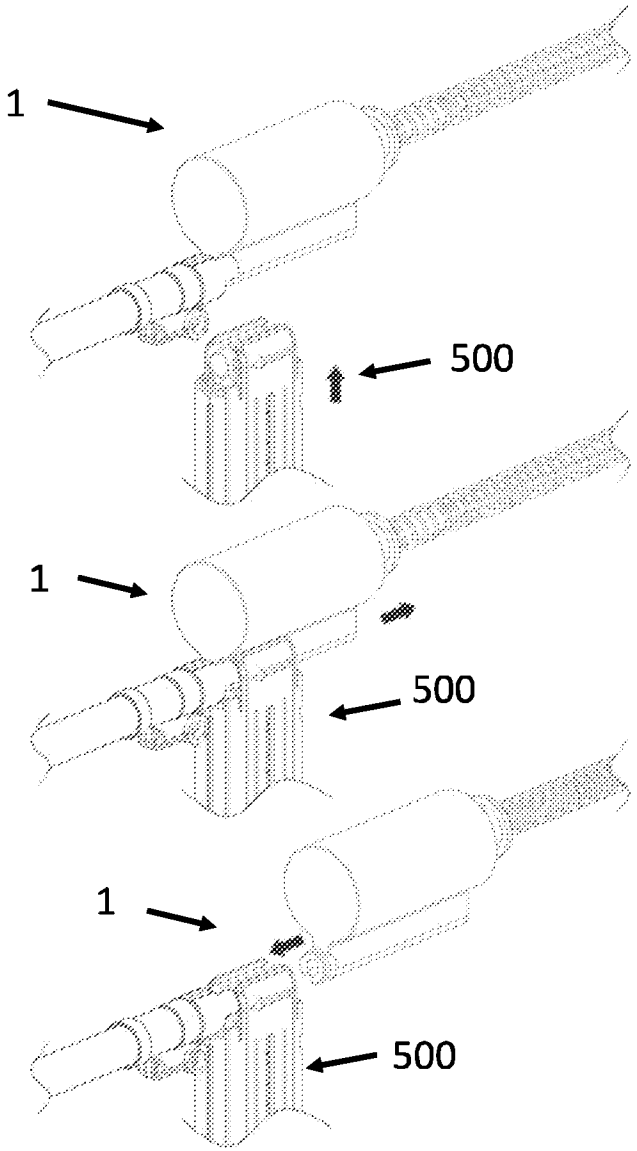
FIGS. 3A-3G show operation of an air piston assembly in loading and firing of a projectile according to an exemplary embodiment of the present invention.
Figure 3D:
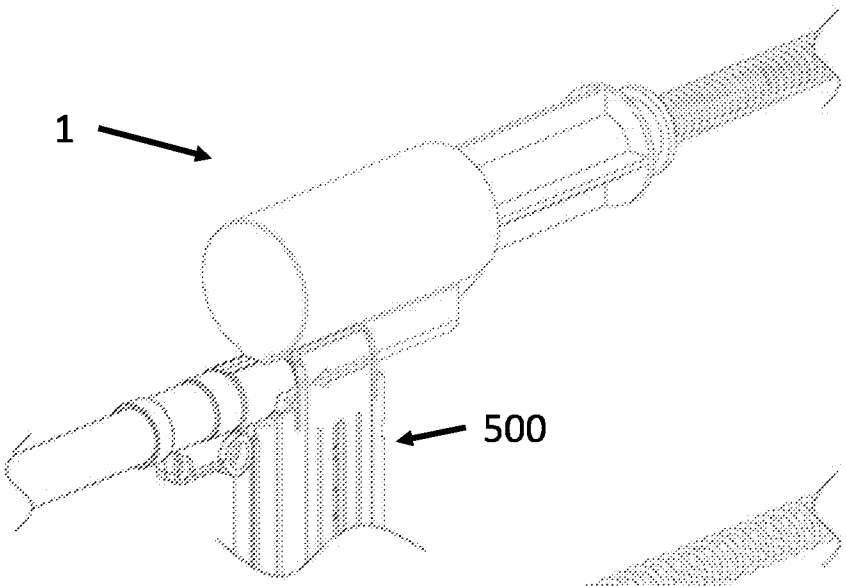
Figure 3E:
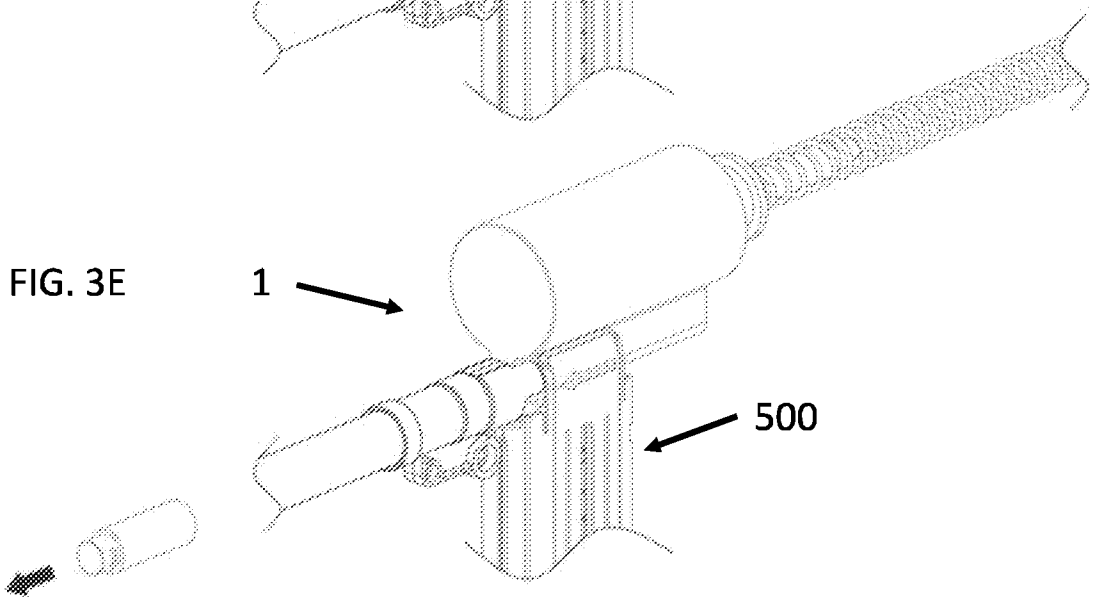
Figure 3G:
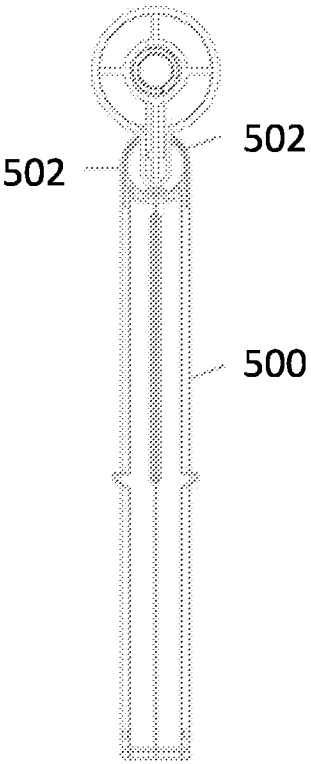
Figure 3F:
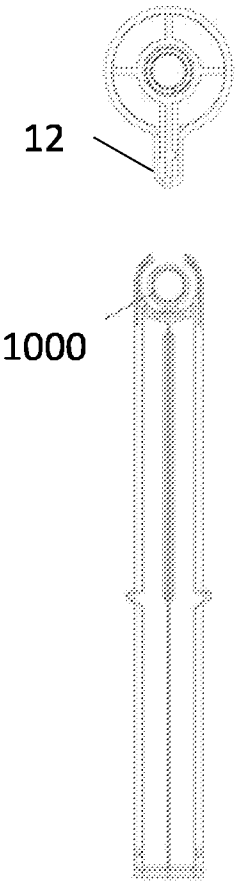

FIGS. 3A-3G show operation of the air piston assembly 1 in loading and firing of a projectile according to an exemplary embodiment of the present invention. FIGS. 3A and 3F show the magazine 500 about to be inserted into the launcher, and FIGS. 3B and 3G show the magazine 500 fully inserted with the piston cylinder extension 12 of the piston cylinder 10 disposed between the upper arms 502 of the magazine 500. At this point, the topmost dart 1000 has been displaced downwards by the piston cylinder extension 12. FIG. 3C shows the piston assembly 1 after it has been pulled back to allow the topmost dart 1000 in the magazine 500 to move up and be held in place by the inwardly biased upper arms 502 of the magazine 500. FIG. 3D shows the piston assembly 1 after it has been pushed forward, resulting in the topmost projectile being pushed into the launch barrel 520. FIG. 3E shows the piston assembly 1 after the piston 10 has been activated to fire the projectile from the launch barrel 520.

FIGS. 4A-4F show operation of a toy launcher, generally designated by reference number 200, according to an exemplary embodiment of the present invention. The launcher 200 has a housing 210, a launch barrel 212 extending through the front of the housing 210, a rear handle 214, a front handle 216, a trigger assembly 220, and an air piston assembly 230 disposed within the housing 210. The launcher 200 is shaped to resemble a rifle and rear handle 214 is shaped to resemble a pistol grip. In embodiments, launcher 200 may be in various other shapes and arrangements without departing from the spirit and the scope of the invention.

The air piston assembly 230 has the same construction as previously described, including a piston cylinder 232 with a piston cylinder extension 234. An air exit hole 236 is formed at the front of the piston cylinder extension 234. The piston cylinder extension 234 is configured to move between two rigid, inwardly biased upper arms 502 of the magazine 500.

The air piston assembly 230 further includes a piston 238 made up of a piston head 240 and a piston arm 242 extending from the piston head 240. A piston spring 244 extends around the piston arm 242. A first O-ring 246 is disposed at the front of the piston head 240. A second O-ring 248 is disposed at the front of the piston cylinder extension 234 and forms an air seal when the air exit hole 236 of the piston cylinder extension 234 has been pushed into the rear of the launch barrel 212 of the launcher. An adapter 250 may be disposed between the bottom extension 234 and the launch barrel 212 to hold the launch barrel 212 in place and also has a flared entrance at the rear to aid the insertion of a projectile, such as a dart.

The front handle 216 is slidably mounted on the housing 210 by a slide 218 that protrudes from an elongated opening at the bottom of the housing 210. The top of the slide 218 is attached to a lever arm 219, which in turn is attached to the front of the piston cylinder 232.

Figures 4A, 4B:
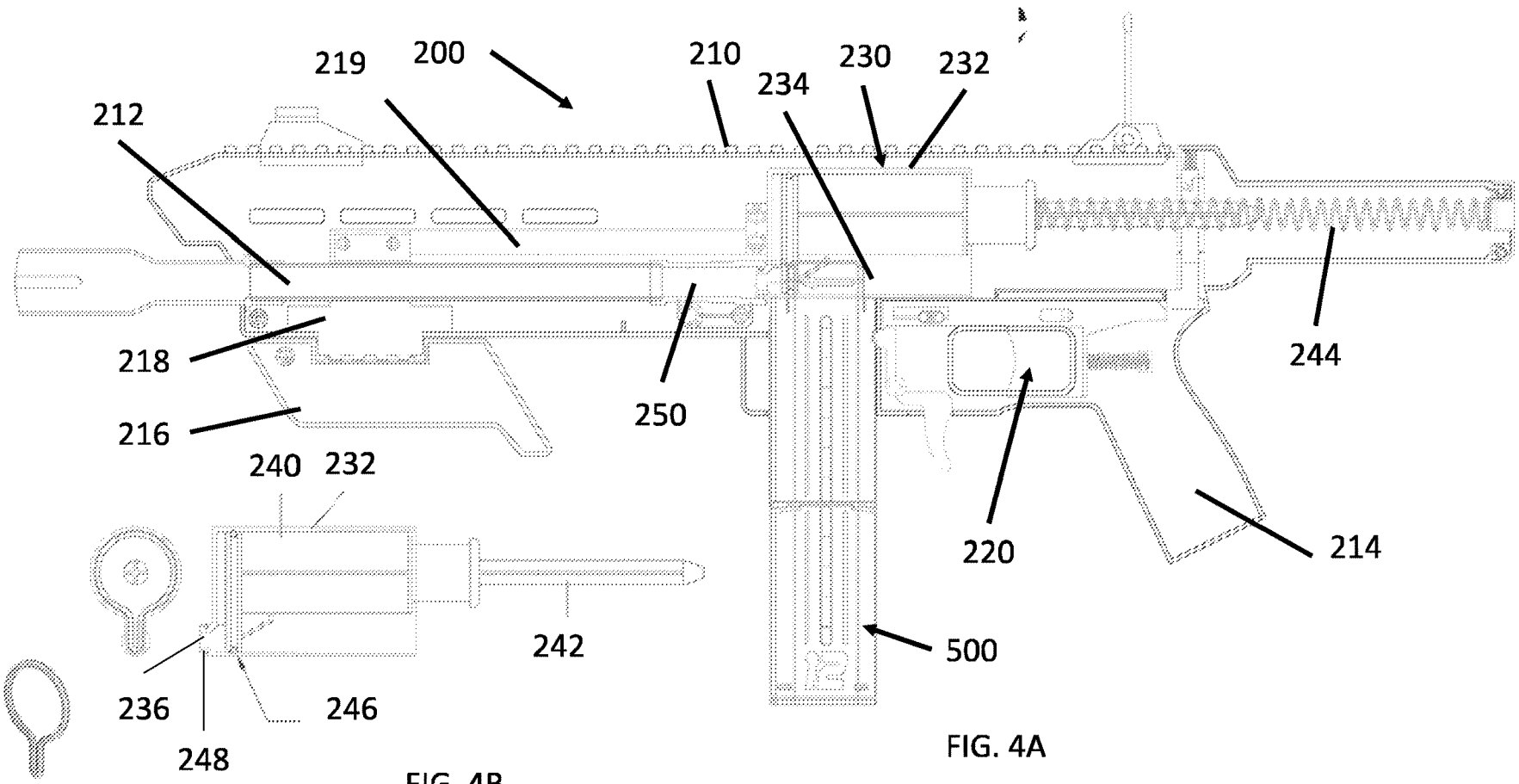
FIGS. 4A-4F show operation of a toy launcher according to an exemplary embodiment of the present invention.
Figure 4C:
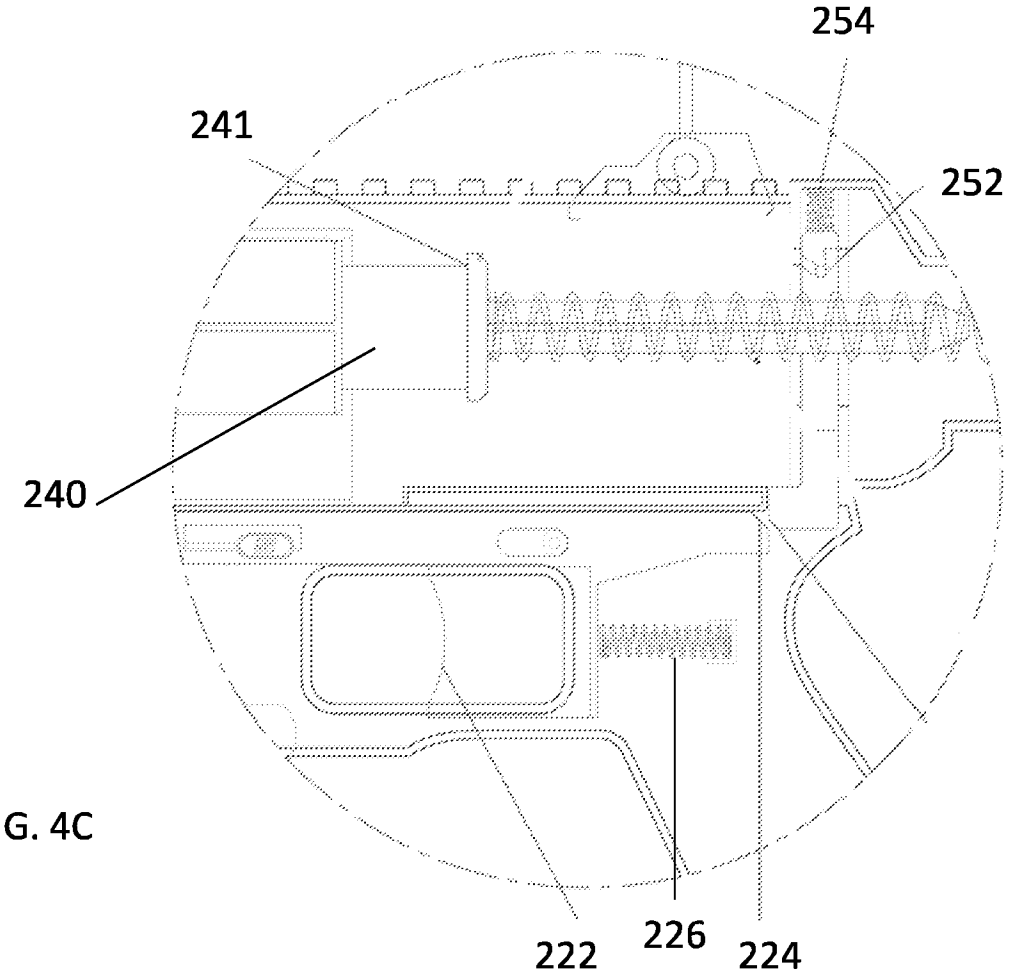

FIG. 4C is a more detailed view of the rear of the air piston assembly 230 and the trigger assembly 220. The rear of the piston head 240 has a flange 241 made up of a front facing vertical wall and a rear facing wall that slopes downwards. A latch assembly 252 extends from the housing 210 and is biased downwards from a top wall of the housing 210 by a first spring 254. The latch assembly 252 includes a front facing wall that slope downwards and a rear facing vertical wall. In exemplary embodiments, the latch assembly 252 may be guided on either side by vertical walls so as to ensure the latch assembly 252 moves only vertically (i.e., in an up and down motion within the housing 210).

The trigger assembly 220 includes a trigger 222, a trigger arm 224 attached to the trigger 222 and a second spring 226 that biases the trigger assembly 220 forward. The trigger arm 224 extends backwards into the housing and engages with the latch assembly 252 upon a pull of the trigger to fire a projectile from the launcher 200, as explained in more detail below.

Figure 4D:
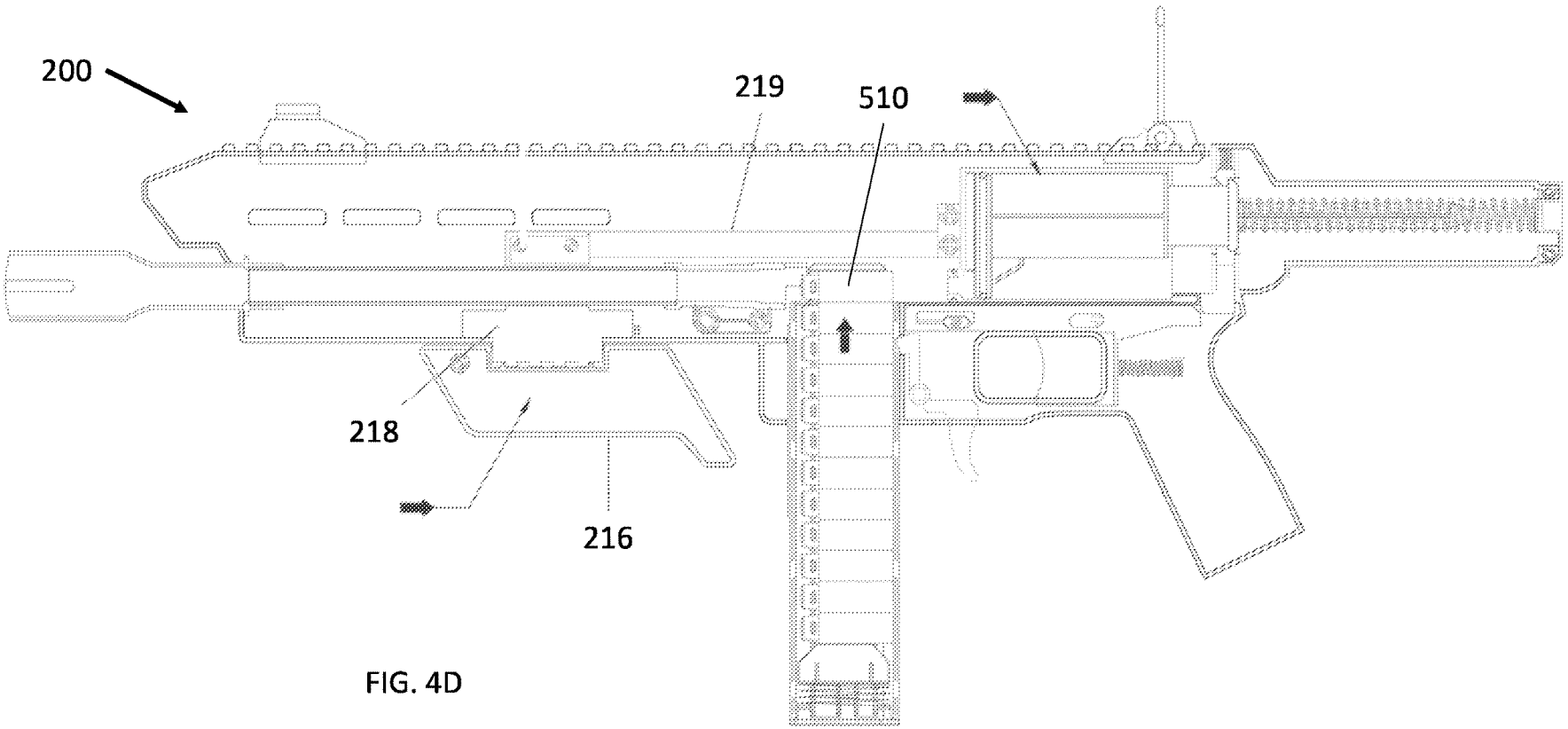

FIG. 4D shows the launcher 200 after the front handle 214 has been slid back towards the rear of the launcher 200. This results in the lever arm 218 pushing the piston cylinder 232 together with the bottom extension 234, piston head 240, piston arm 242 and piston spring 244 back towards the rear wall of the housing 210, and also results in compression of the piston spring 244. The air piston assembly 230 is pushed rearward until the sloping wall at the rear of the piston head 240 passes over the sloping wall of the latch 252, at which point the vertical wall of the latch 252 engages with the vertical wall of the piston head 240, thereby locking the piston head 240 in a cocked position. The rearward motion of the piston cylinder extension 234 also allows a topmost dart 510 in the magazine 500 to be pushed upward to a position in line with the launch barrel 212.

Figure 4E:
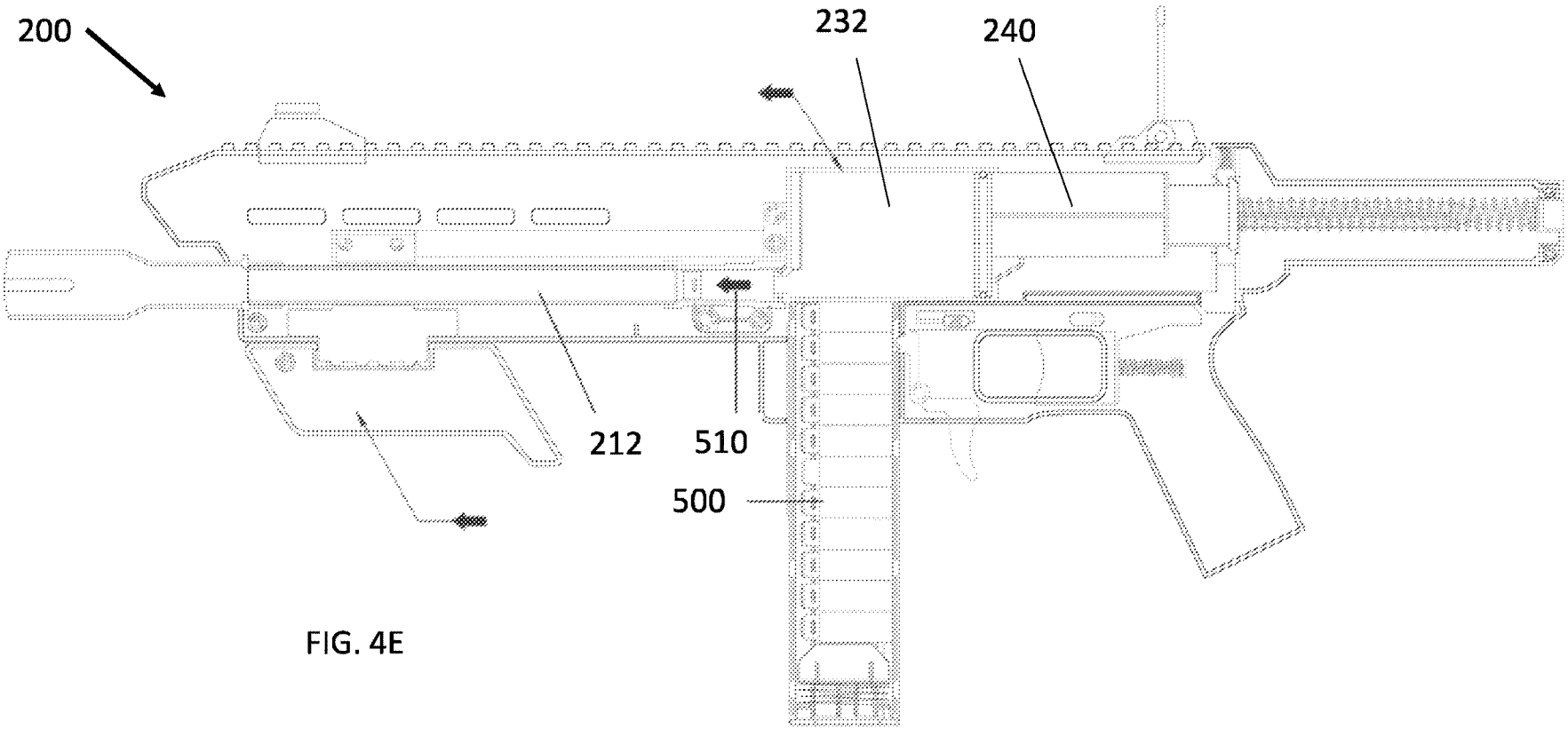

FIG. 4E shows the launcher 200 after the front handle 214 has been slid forward again to complete the loading stroke. The forward movement of the front handle 214 results in the piston cylinder 232 being pulled forward, thereby creating an air volume between the front wall of the piston cylinder 232 and the front wall of the piston head 240 (which remains in the cocked position behind the piston cylinder 232). The forward motion also pushes the dart 510 forward into the rear of the launch barrel 212 to create an air seal for rapid expulsion. At this point, the air exit hole 236 of the piston cylinder extension 234 is aligned with the rear of the dart 510.

Figure 4F:
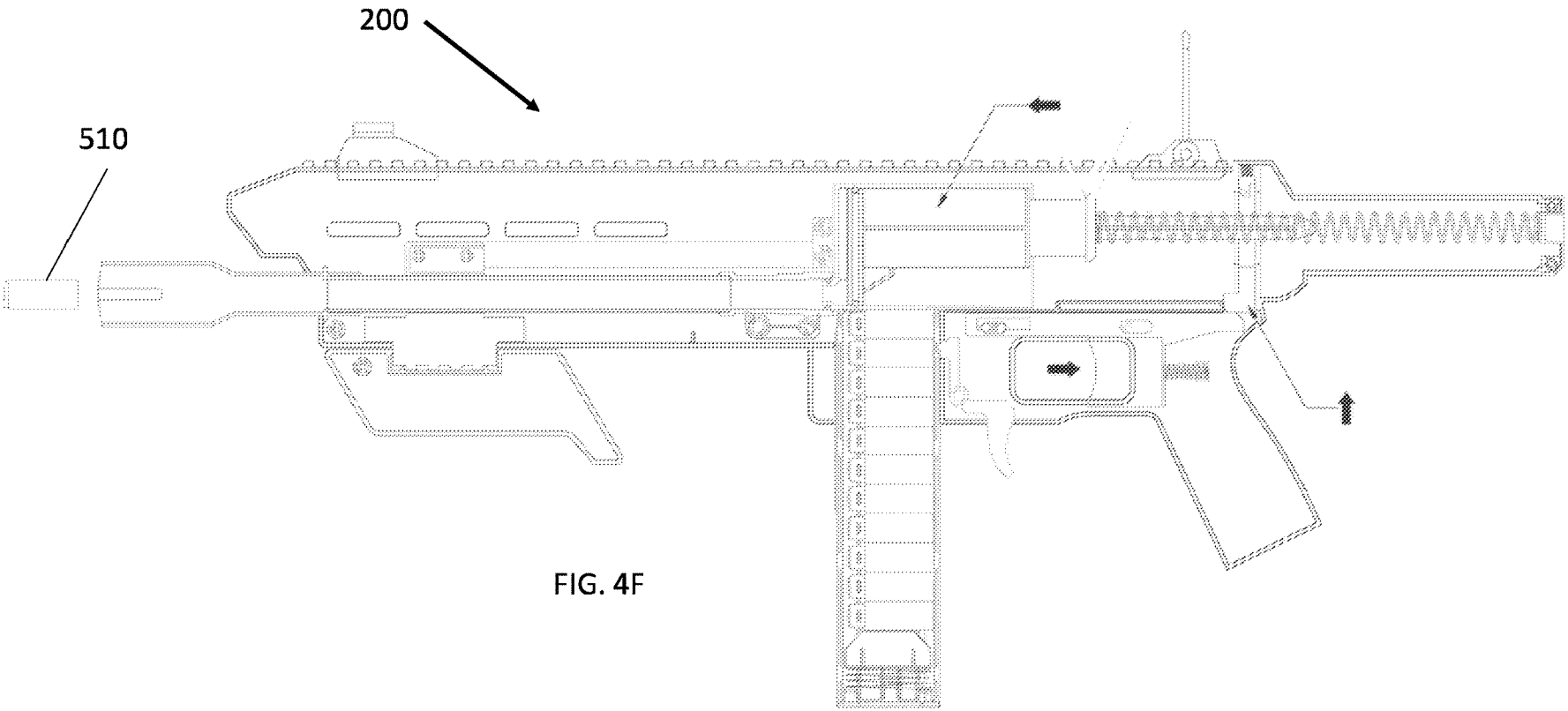

FIG. 4F shows the launcher 200 after the trigger 222 has been pulled. The corresponding rearward movement of the trigger arm 224 results in a sloped rear wall of the trigger arm 224 engaging with a slope bottom wall of the latch assembly 252, thereby pushing the latch assembly 252 upwards. This in turn results in the vertical wall of the latch assembly 252 moving upwards and out of engagement with the vertical wall of the piston head 240, thereby releasing the piston head 240 and allowing the piston spring 244 to push the piston head 240 rapidly forward into the piston cylinder 232. The rapid forward motion of the piston head 240 within the piston cylinder 232 and the piston head protrusion within the piston cylinder extension 234 results in expulsion of air from the air exit hole 236 of the piston cylinder extension 234, thereby driving the dart 510 forward and out of the launch barrel 212.

Figures 5A, 5B, 5C:
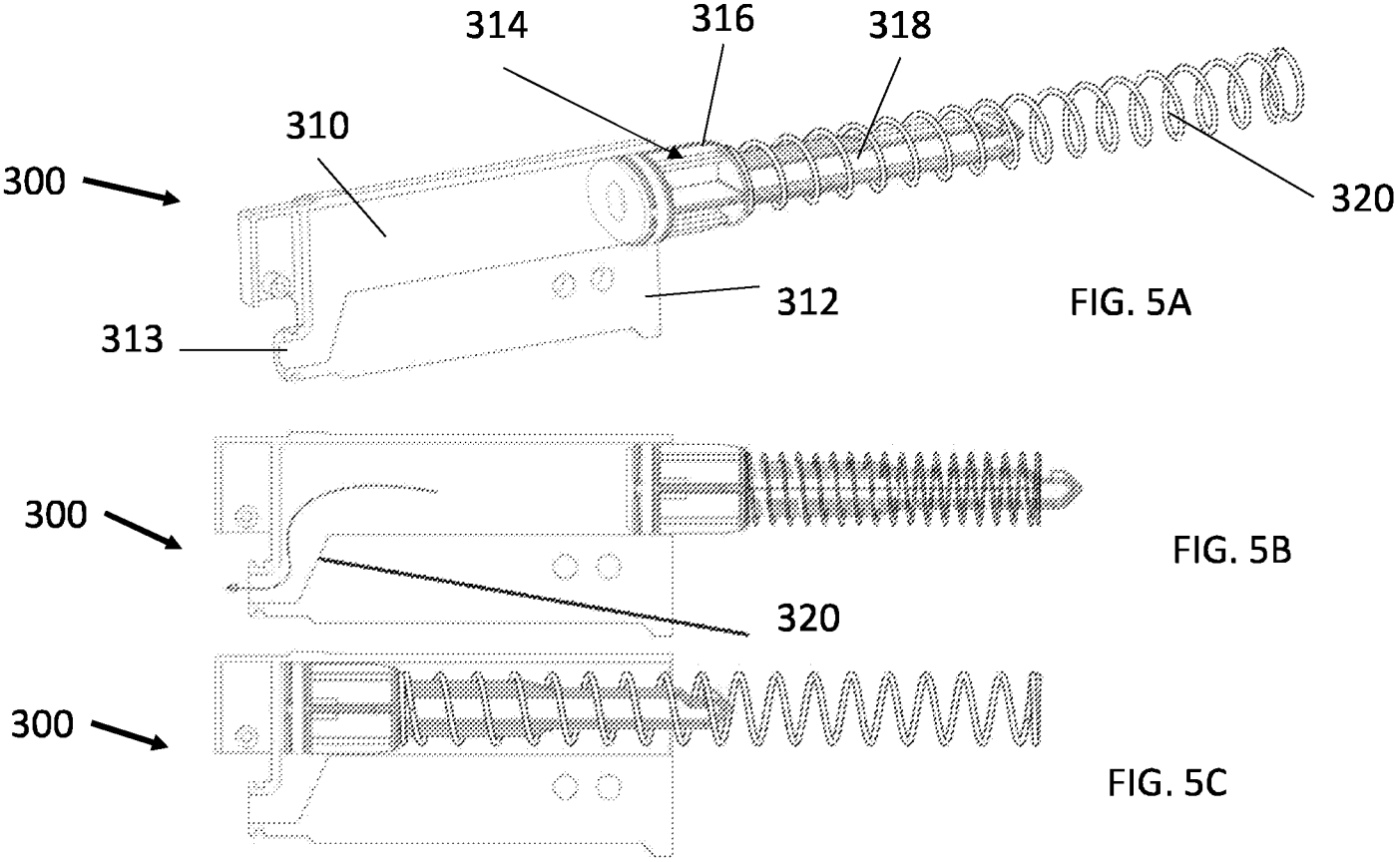
FIGS. 5A-C show an air piston assembly according to another exemplary embodiment of the present invention.

FIGS. 5A-C show an air piston assembly, generally designated by reference number 300, according to another exemplary embodiment of the present invention. The air piston assembly 300 is generally the same as that described in previous exemplary embodiments, except that the front of the piston head does not have a protrusion that is configured to extend into the piston cylinder extension. The air piston assembly 300 is made up of a piston cylinder 310 with a piston cylinder extension 312. An air exit hole 313 is formed at the front of the piston cylinder extension 312. The piston cylinder extension 312 is configured to move between two rigid, inwardly biased upper arms of a magazine. Although the piston cylinder extension 312 is shown protruding from the bottom of the piston cylinder 310, it should be appreciated that in other exemplary embodiments the piston cylinder extension 312 may protrude from the top of the piston cylinder 310 in the case of, for example, a top loading launcher.

The piston cylinder assembly 300 further includes a piston 314 made up of a piston head 316 and a piston arm 318 extending from the piston head 316. A piston spring 320 extends around the piston arm 318. In operation, upon being driven forward by a trigger pull, the piston head 316 drives air forward and downward into the piston cylinder extension 312 and out of the air exit hole 313 of the piston cylinder extension 312, to thereby fire a dart from the launcher. In this regard, the piston cylinder extension 312 may include a sloped inner wall 320 that directs air flow towards the air exit hole 313.

While particular embodiments of the present invention have been shown and described in detail, it would be obvious to those skilled in the art that various modifications and improvements thereon may be made without departing from the spirit and scope of the invention. It is therefore intended to cover all such modifications and improvements that are within the scope of this invention.

What is claimed is:

1. An air piston assembly comprising:

a piston cylinder comprising a main cylinder portion and a piston cylinder extension portion, an air exit hole disposed at a front of the piston cylinder extension portion, the piston cylinder extension portion extending vertically from a side wall of the main cylinder portion so that a longitudinal axis of the main cylinder portion and a longitudinal axis of the piston cylinder extension portion are parallel to one another, the piston cylinder extension portion configured to travel between extension arms of a projectile magazine;

a piston head configured to travel in and out of the piston cylinder, the piston head comprising an extension that is aligned with the piston cylinder extension portion;

a piston arm extending from the piston head; and a piston spring disposed around the piston arm.

2. The air piston assembly of claim 1, further comprising an O-ring disposed at the front of the piston head.

3. The air piston assembly of claim 1, further comprising an O-ring disposed at the front of the piston cylinder extension portion.

4. The air piston assembly of claim 1, further comprising an adapter for connecting the piston cylinder extension portion to a launch barrel of a toy projectile launcher.

5. The air piston assembly of claim 1, wherein the piston head is configured to be propelled forward by the piston spring upon release of the piston head from a locked position so as to drive air from the piston cylinder and out of the air exit hole to fire a toy projectile from a launcher.

6. A toy launcher comprising the air piston assembly of claim 1.

7. A toy launcher comprising:

a housing;

a launch barrel;

a rear handle extending from the housing;

a front handle slidably disposed on the housing and attached to a lever arm within the housing;

an opening in the housing configured for insertion of a spring-loaded magazine that holds projectiles;

a trigger assembly comprising a trigger and a trigger arm attached to the trigger; and an air piston assembly disposed within the housing and comprising:

a piston cylinder comprising a main cylinder portion and a piston cylinder extension portion that extends vertically from a side wall of the main cylinder portion so that a longitudinal axis of the main cylinder portion and a longitudinal axis of the piston cylinder extension portion are parallel to one another, the piston cylinder extension portion configured to travel between extension arms of the magazine, the piston cylinder extension portion comprising an air exit hole and the piston cylinder being attached to the lever arm;

a piston head configured to travel in and out of the piston cylinder, the piston head comprising an extension that is aligned with the piston cylinder extension portion;

a piston arm extending from the piston head; and a piston spring disposed around the piston arm, wherein upon sliding of the front handle backwards, the air piston assembly is pushed backwards by the lever arm, the piston head is locked into a cocked position, and a top-most projectile within the magazine is pushed into a position within the launcher formerly occupied by the piston cylinder extension portion;

wherein upon sliding of the front handle forwards the piston cylinder is pulled forward by the lever arm to thereby create a volume of air within the piston cylinder and to push the top-most projectile into the launch barrel; and wherein upon activation of the trigger the piston head is released from the cocked position and is driven forward into the piston cylinder by the piston spring to thereby eject the volume of air from the piston cylinder and out of the air exit hole of the piston cylinder extension portion to fire the top-most projectile from the launch barrel.

8. The toy launcher of claim 7, further comprising a latching assembly that locks the piston head in the cocked position.

9. The toy launcher of claim 8, wherein, upon activation of the trigger, the trigger arm engages with the latching assembly to release the latching assembly from the piston head.

10. The toy launcher of claim 7, further comprising an O-ring disposed at the front of the piston head.

11. The toy launcher of claim 7, further comprising an O-ring disposed at the front of the piston cylinder extension portion.

12. The toy launcher of claim 7, further comprising an adapter for connecting the piston cylinder extension portion to the launch barrel.

13. The toy launcher of claim 7, wherein the piston cylinder extension portion protrudes from a top portion of the piston cylinder.

14. The toy launcher of claim 7, wherein the piston cylinder extension portion protrudes from a bottom portion of the piston cylinder.

15. The toy launcher of claim 7, wherein the projectiles are foam darts.

* * * * *